United States Patent [19]

Jamison

[11] 3,938,121

[45] Feb. 10, 1976

[54] ELECTRICAL WIRING AND ALARM SYSTEM

[76] Inventor: Fred W. Jamison, 215 E. Palm Ave., Apt 411, Tampa, Fla. 33602

[22] Filed: Aug. 7, 1974

[21] Appl. No.: 495,322

[52] U.S. Cl. ..... 340/274 R; 340/224
[51] Int. Cl.[2] ..... G08B 13/08
[58] Field of Search ..... 340/274, 416, 224; 307/116, 112, 12

[56] References Cited

UNITED STATES PATENTS

| | | | |
|---|---|---|---|
| 2,484,092 | 10/1949 | Hopgood | 307/112 |
| 3,011,163 | 11/1961 | Britt | 340/274 |
| 3,470,554 | 9/1969 | Corbell | 340/274 |
| 3,514,557 | 5/1970 | Jette, Jr. | 307/112 |
| 3,540,043 | 11/1970 | Crosthwait | 340/224 |
| 3,543,268 | 11/1970 | Jamison | 340/416 |

*Primary Examiner*—Glen R. Swann, III
*Attorney, Agent, or Firm*—Oltman and Flynn

[57] ABSTRACT

A three-wire electrical wiring and alarm system has a remotely located alarm device that is turned on whenever an alarm switch is actuated. The alarm device may be wired into the system or it may be operated by a radio signal broadcast from the premises to be protected. In either case an unauthorized intruder is not made aware that the alarm has been signalled. The system has a manual alarm switch and a plurality of intrusion alarm switches, each operated automatically when a corresponding window or door is opened. Manually operated selector switches are provided for disconnecting the alarm switches from power sockets in the wiring system and for selectively enabling the window and door switches. A timer keeps the alarm device on for a predetermined time period following the operation of an alarm switch.

11 Claims, 2 Drawing Figures

Fig. 1
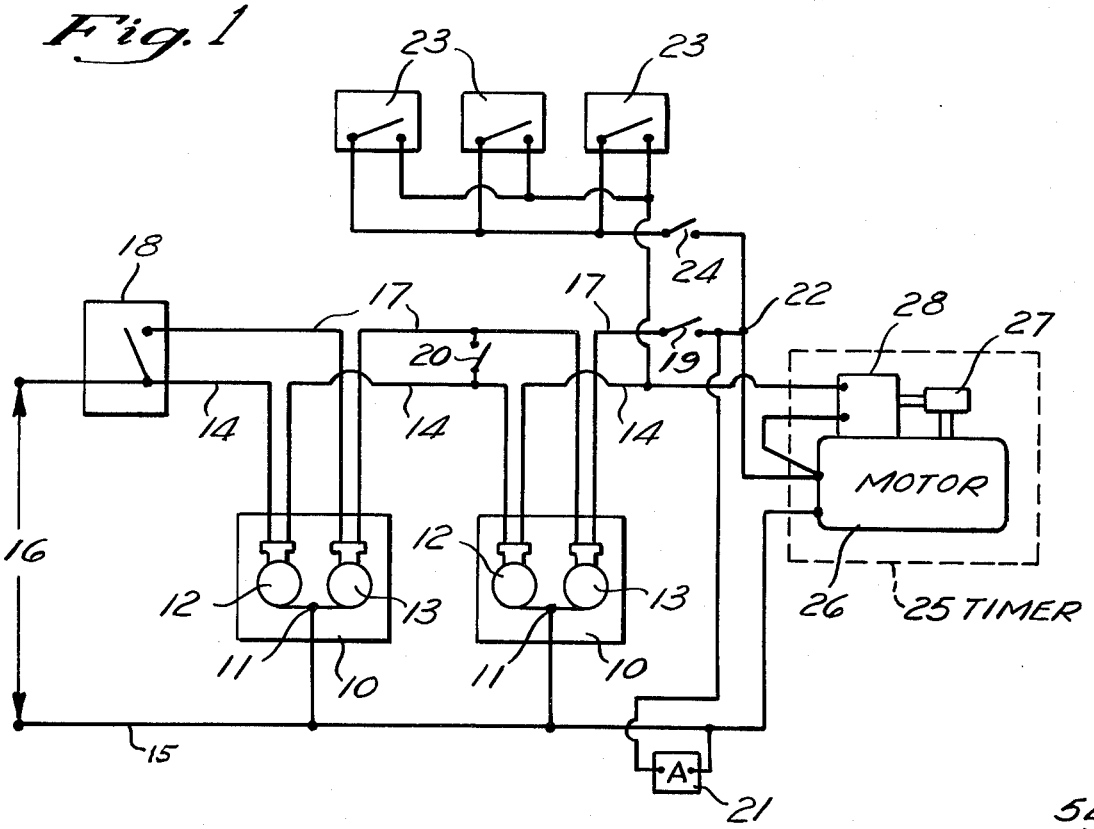
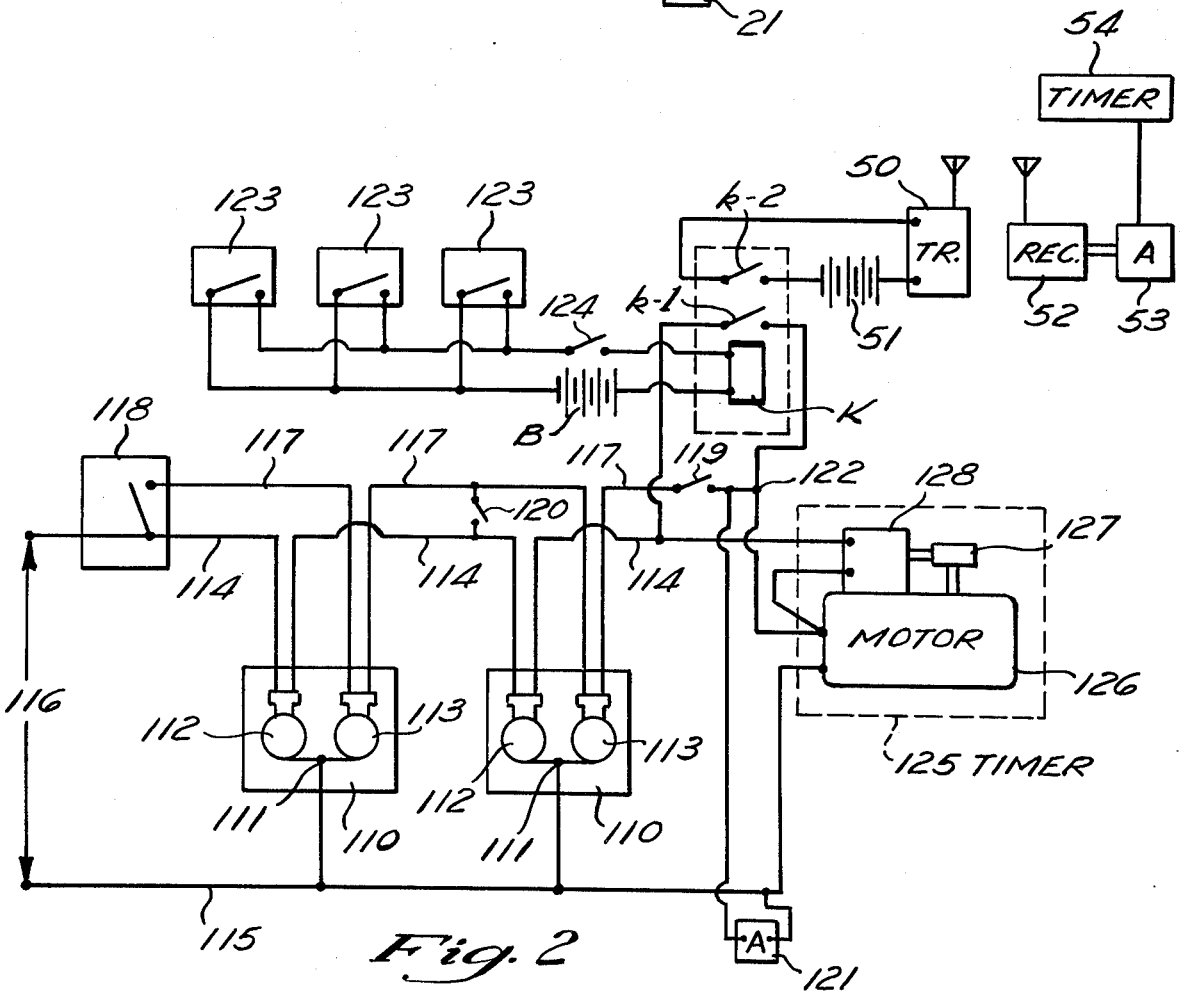
Fig. 2

ELECTRICAL WIRING AND ALARM SYSTEM

CROSS-REFERENCE TO RELATED DISCLOSURE DOCUMENT

The present application is directed to modifications of the invention disclosed in my Disclosure Document No. 013135, filed in the U.S. Patent Office.

BACKGROUND OF THE INVENTION

In my U.S. Pat. Nos. 3,466,454 and 3,543,268, I have disclosed and claimed an electrical wiring arrangement, including a special socket, which is designed to integrate an intrusion alarm system with the wiring system for the lighting and various electrically operated appliances in a residence.

SUMMARY OF THE INVENTION

The present invention is directed to modifications or improvements in the integrated wiring and alarm system of said patents which provide a silent alarm so that the intruder is not alerted to the fact that his presence has been detected, as would be the case if an audible alarm device were located at the protected premises.

A principal object of this invention is to provide a novel and improved integrated wiring and alarm system, particularly for a residence, which has a switching arrangement for turning on a remotely located alarm device.

Another object of this invention is to provide such a system in which the remotely located alarm device is wired into the integrated wiring and alarm system.

Another object of this invention is to provide a system as first described in which the remotely located alarm device is operated by a radio signal broadcast from the premises to be protected.

Another object of this invention is to provide a three wire integrated wiring and alarm system having a novel selector switch arrangement for disconnecting the alarm switch arrangement from power sockets in the system.

BRIEF DESCRIPTION OF THE DRAWING

Further objects and advantages of this invention will be apparent from the following detailed description of two presently-preferred embodiments, which are illustrated schematically in the accompanying drawing in which:

FIG. 1 is a schematic electrical circuit diagram of a first embodiment of the present wiring and alarm system;

FIG. 2 is a similar view of a second embodiment of the present system.

DESCRIPTION OF THE PREFERRED EMBODIMENTS

FIG. 1.

Referring first to FIG. 1, the system has one or more receptacles 10, such as wall sockets, which preferably are constructed as disclosed in my previously-mentioned U.S. Pat. No. 3,466,454. Each receptacle has a common terminal 11 and first and second supply terminals 12 and 13, which are arranged such that an electrical plug (not shown) can be plugged into the first supply terminal 12 and the common terminal 11, and at the same time a second electrical plug can be plugged into the second supply terminal 13 and the common terminal 11. The three terminals 11, 12 and 13 are electrically insulated from each other.

A first line conductor 14 is connected to the first supply terminals 12 of the sockets 10. A second line conductor 15 is connected to the common terminals 11 of these sockets. These line conductors 14 and 15 are connected across a suitable 115 volt A.C. power supply 16. With this arrangement, whenever an electrical appliance is plugged into the terminals 12, 11 of any one of the wall sockets 10, that appliance is connected across the power supply 16.

A third-line conductor 17 is connected to the second supply terminals 13 of the sockets. A normally-open, manually operated switch 18 is connected between the first and third line conductors 14 and 17 at the left end of line conductor 17 in FIG. 1. When this switch is closed, the third line conductor 17 and the second line conductor 15 are connected across the power supply 16 at the same time that the first line conductor 14 and the second line conductor 15 are connected across this power supply. Consequently, if an electrical appliance, such as a lamp, is plugged into the terminals 13 and 11 of any one of the wall sockets, that appliance will be energized whenever the switch 18 is closed.

Switch 18 is a wall switch located near an entry to a room or near an entry to the residence having this wiring system.

To the right of the last receptacle 10 in FIG. 1, a selector switch 19 is connected between the third line conductor 17 and a juncture 22.

A manual alarm switch 20 bridges the first and third line conductors 14 and 17. Preferably, the alarm switch 20 is under the homeowner's pillow so as to be immediately accessible to him after he has gone to bed.

An audible alarm device 21, such as a bell or siren, is connected between the second line conductor 15 and the juncture 22. This alarm device, while it is wired into the power supply and alarm system at the premises to be protected, is physically located outside these premises, such as in a neighbor's apartment or house, so that it cannot be heard in the protected premises.

A plurality of automatic intrusion alarm switches 23 are connected in parallel with each other between the first line conductor 14 and one side of a selector switch 24, whose opposite side is connected to the aforementioned juncture 22. Preferably, an intrusion alarm switch 23 is located at each window, door or other possible entry point into the residence which has a closure that an intruder might be able to open. Each such alarm switch is constructed and arranged to close automatically in response to the opening of the building closure, such as a window or door, where it is located. It may be a mechanically operated switch, a mercury switch, a magnetic switch, or any other type of switch that will detect the opening of the window, door or other building closure with which it is associated.

In this circuit, the two individual selector switches 19 and 24 are each part of a selector switch means for controlling the connections of the intrusion alarm switches 23 in the system. The automatic intrusion alarm switches 23 together constitute an alarm switch means in the system.

When selector switch 19 is open, it disconnects the manual alarm switch 20 from the audible alarm device 21.

When either selector switch 19 or 24 is open, as shown, it disconnects the automatic intrusion alarm switches 23 from the second supply terminals 13 in the receptacles 10. Consequently, the closing of any of these alarm switches will not turn on the lamps which are plugged into these terminals 13.

When selector switch 24 is open, it disconnects the automatic intrusion alarm switches 23 from the remotely located audible alarm device 21.

Whenever the alarm device 21 is turned on, it is kept on for a predetermined time interval by a timer 25, as disclosed in my previous U.S. Pat. No. 3,543,268. This timer has an electric motor 26 driving a rotary cam 27 for operating the contacts of a normally-open switch 28. One side of the motor winding is connected to the juncture 22 between selector switches 19 and 24. The opposite side of the motor winding is connected to the second line conductor 15. Switch 28 is connected between the first line conductor 14 and the juncture 22.

OPERATION - FIG. 1

In the operation of this system, when the alarm signalling circuitry is to be used, the selector switch 19 is opened, so that the closing of any automatic intrustion alarm switch 23 will not turn on the lights that are plugged into the second supply terminals 13. Selector switch 24 is closed, so that the remote alarm signalling device 21 can be turned on by closing of any automatic intrusion alarm switch 23.

If a lawful occupant of the protected premises hears an unauthorized intruder enter, he can close the manual switch 20 to turn on the lights plugged into the socket terminals 13 for the purpose of frightening away the intruder. The closing of manual alarm switch 20 does not turn on the remote alarm device 21 and it does not turn on the timer 25. The closing of any of the automatic intrusion alarm switches 23 (with selector switch 24 closed) completes the energization circuit across the first and second line conductors 14 and 15 for the remotely located audible alarm device 21. The momentary closing of any switch 23 also completes an energization circuit for the winding of the timer motor 26 across line conductors 14 and 15. The now-energized motor 26 turns its cam 27, which now closes switch 28 to maintain the motor winding energized independent of the switches 23 for as long as cam 27 continues to hold switch 28 closed.

Alternatively, during the day, selector switch 19 is open, selector switch 24 is closed, switch 18 controls lights plugged into sockets 13 with switches 23 controlling alarm 21, timer 25, and motor 26. At night, selector switch 19 and switch 24 are both closed. When switch 20 or switches 23 are closed, they will activate alarm 21, timer 25, motor 26 and all lights plugged into sockets 13.

FIG. 2

FIG. 2 illustrates a second embodiment of this system which differs from the embodiment of FIG. 1 in that it has radio transmitter at the protected premises which is turned on by a battery-operated relay forming part of the alarm switch means in the system. Corresponding elements of the FIG. 2 circuit have the same reference numerals, plus 100, as those in FIG. 1, and the detailed description of these circuit elements and their operation will not be repeated.

Each of the automatic intrusion alarm switches 123 in FIG. 2 is connected in series with the coil K of a relay across a 12 volt battery B through a manual selector switch 124. The relay has a normally-open first set of contacts *k*-1 connected between the first line conductor 114 and the juncture 122 at the opposite side of selector switch 119 from the second supply terminals 113 of the receptacles 110.

A radio transmitter 50 at the protected premises is connected across a battery 51 through a normally-open second set of relay contacts *k*-2. These contacts close and the transmitter 50 is turned on in response to the energization of the relay coil K.

A radio receiver 52 tuned to the transmitter 50 is located at a suitable place away from where the intruder might hear an audible alarm device, such as a siren or bell. For example, the receiver 52 may be located in a neighbor's house or in a central alarm monitoring station serving several different residences or at a police station. Upon receiving the radio alarm signal, the receiver 52 turns on an audible or visual alarm signalling device or other alarm condition indicator 53 to warn that an unauthorized intrusion has occurred at the premises where the radio transmitter 50 is located. This indicator 53 is provided with a timer 54 which keeps it on for a predetermined time interval after its initial turn-on by the receiver 52. This timer may be essentially similar to the timer 125 and it need not be described in detail.

In this system the alarm switch means includes the manual alarm switch 120, the automatic intrusion alarm switches 123, and the relay contacts *k*-1 and *k*-2. The selector switch means in the system consists of the individual manually-operated selector switches 119 and 124.

OPERATION - FIG. 2

In the operation of this system, whenever the alarm system is to be activated, the selector switch 119 is opened, so that the lights plugged into the second terminals 113 of the receptacles 110 will not come on when an automatic intrusion alarm switch 123 is closed.

Whenever the manual alarm switch 120 is closed, these lights will come on but the remotely-located wired-in alarm device 121 will not be turned on, nor will the timer 125.

The automatic intrusion alarm switches 123 are activated by closing the selector switch 124. Now if any one of these switches 123 is closed the relay coil K will be energized and its contacts *k*-1 and *k*-2 will close.

The closing of the *k*-1 contacts turns on the timer 125, and the closing of the switch 128 in the timer turns on the wired-in, remotely-located alarm device 121 and keeps it on for the time interval that cam 127 holds switch 128 closed.

The closing of the *k*-2 contacts turns on the radio transmitter 50, which broadcasts a signal to the remotely-located receiver 52, and the latter turns on the audible or visual alarm condition indicator 53. This indicator is kept energized by its timer 54 for a predetermined time interval.

If desired, in either the system of FIG. 1 or the system of FIG. 2, a heat switch (not shown) may be connected across lines 14 and 17 (FIG. 1) or 114 and 117 (FIG. 2) to operate an automatic telephone dialer for calling the fire department whenever the temperature rises to a point indicating that a fire is taking place in the protected premises.

I claim:

1. In an electrical wiring and alarm system at a premises to be protected, said system having:

one or more receptacles, each having a common terminal and first and second supply terminals insulated from each other and from said common terminal and arranged so that one plug can be plugged into said first and common terminals and another plug can be concurrently plugged into said second and common terminals;

a first line conductor connected to said first supply terminals and connected to one side of a current supply;

a second line conductor connected to said common supply terminals and connected to the other side of said current supply;

a third line conductor connected to said second supply terminals;

and a wall switch connected between said first and third line conductors and operable when closed to connect said third line conductor to said one side of the current supply for turning on lights which are plugged into said second and common terminals of said one or more receptacles;

the improvement which comprises;

alarm switch means and first selector switch means connected by circuit means in series with each other between said first line conductor and said second supply terminals of the receptacles, whereby the opening of said first selector switch means disconnects said alarm switch means from said second supply terminals, said circuit means having a junction between said alarm switch means and said first selector switch means;

alarm signalling means operatively connected to said junction to be activated in response to the closing of said alarm switch means;

and second selector switch means connected in said circuit means for controlling the connection of said alarm switch means to said alarm signalling means.

2. A system according to claim 1, wherein said alarm switch means comprises one or more intrusion alarm switches, each arranged to be closed by the opening of a corresponding door or window leading into the premises to be protected.

3. A system according to claim 2, and further comprising a manually-operated switch in the premises to be protected bridging said first and third line conductors for turning on the lights plugged into said second and common terminals of said one or more receptacles.

4. A system according to claim 1, wherein said alarm switch means comprises a set of relay contacts operated by a relay coil and one or more intrusion alarm switches controlling the energization of said relay coil and arranged to be closed by the opening of a door or window leading to the premises to be protected.

5. A system according to claim 4, wherein said second selector switch means comprises a manual selector switch connected between said relay coil and said one or more intrusion alarm switches for selectively disabling the latter from controlling the energization of said relay coil.

6. A system according to claim 1, wherein said alarm signalling means comprises an audible signalling device located outside the premises to be protected and connected in series with said alarm switch means between said first and second line conductors.

7. A system according to claim 6, and further comprising a manually-operated switch in the premises to be protected for turning on the lights plugged into said second and common terminals of said one or more receptacles.

8. A system according to claim 6, wherein said alarm switch means comprises one or more intrusion alarm switches each arranged to be closed by the opening of a respective door or window leading into the premises to be protected.

9. A system according to claim 1, wherein said system further includes:

a radio transmitter located at the premises to be protected and connected to be turned on by the closing of said alarm switch means;

a radio receiver located away from the premises to be protected for receiving the alarm signal broadcast by said transmitter;

and an alarm condition indicator operated by said receiver.

10. A system according to claim 9, and further comprising:

a relay having normally-open contacts connected to said transmitter;

a battery for energizing said relay to close said contacts for turning on said transmitter;

and means connecting said alarm switch means between said battery and said relay.

11. A system according to claim 10, wherein said alarm switch means comprises a plurality of intrusion alarm switches connected in parallel and each arranged to be closed by the opening of a corresponding door or window leading into the protected premises.

* * * * *